United States Patent [19]

Easterling

[11] 4,177,506

[45] Dec. 4, 1979

[54] ILLUMINATED BAR FOR AN ADVERTISING SIGN

[76] Inventor: Jimmy W. Easterling, P.O. Box 1248, Clanton, Ala. 35045

[21] Appl. No.: 908,201

[22] Filed: May 22, 1978

[51] Int. Cl.[2] ..... F21S 1/12

[52] U.S. Cl. ..... 362/414; 362/240; 362/812

[58] Field of Search ..... 362/232, 238, 240, 368, 362/370, 414, 812

[56] References Cited

U.S. PATENT DOCUMENTS

| | | | |
|---|---|---|---|
| 1,723,471 | 8/1929 | Dunham | 362/812 X |
| 2,409,957 | 10/1946 | Reynolds | 362/812 X |
| 2,465,034 | 3/1949 | Peters | 362/812 X |
| 2,507,350 | 5/1950 | Russell, Jr. | 362/812 X |
| 2,565,575 | 8/1951 | Rosenthal | 362/812 X |
| 2,612,548 | 9/1952 | Swanson | 362/812 X |
| 2,623,313 | 12/1952 | Fuchs | 362/812 X |
| 2,638,584 | 5/1953 | Fortney | 362/370 X |
| 3,296,431 | 1/1967 | Green | 362/812 X |
| 3,700,877 | 10/1972 | Wilson | 362/240 X |
| 4,058,718 | 11/1977 | Palka | 362/238 |

*Primary Examiner*—Peter A. Nelson

*Attorney, Agent, or Firm*—Woodford R. Thompson, Jr.

[57] ABSTRACT

An illuminated bar for a sign embodying a housing having side members spaced from each other with a lamp mounted therebetween. Magnifying lenses are carried by the side members at opposite sides of the lamp in position to transmit and magnify light emitted at opposite sides of the lamp.

4 Claims, 4 Drawing Figures

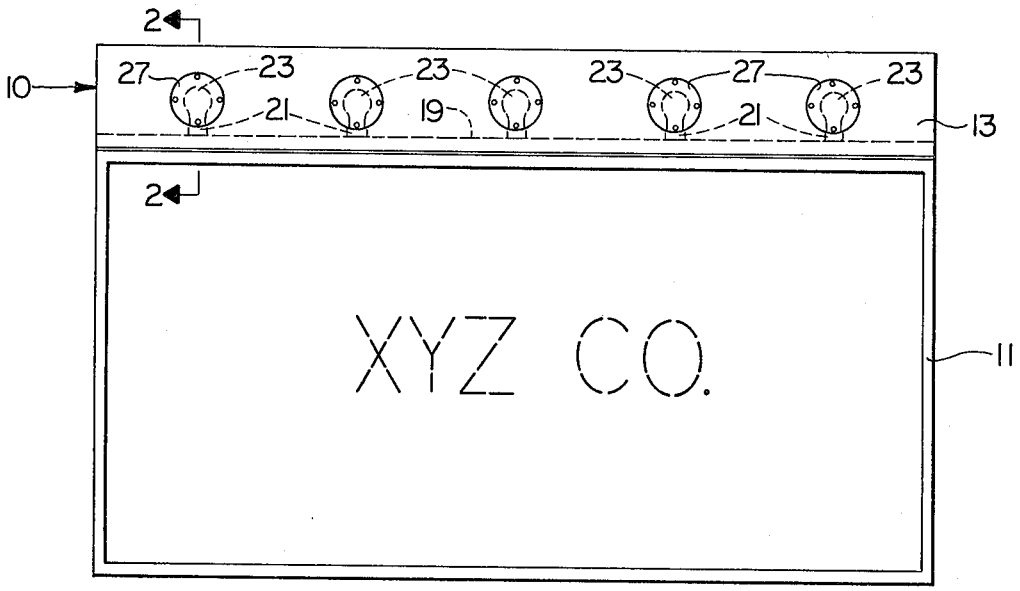
FIG. 1
FIG. 2
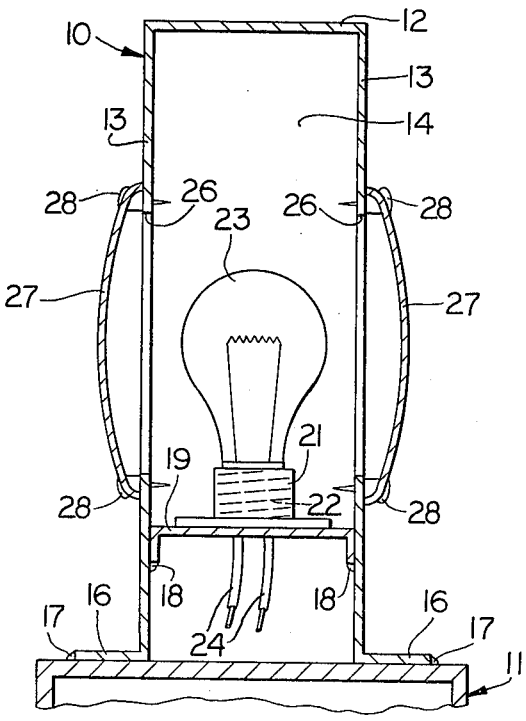
FIG. 4
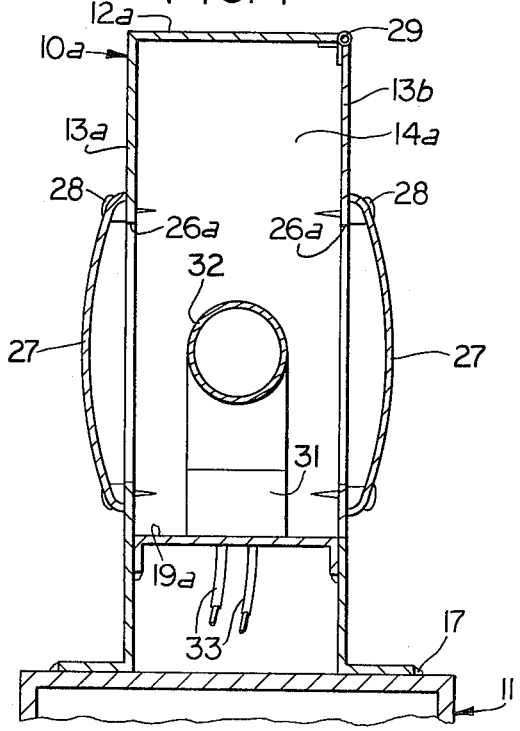
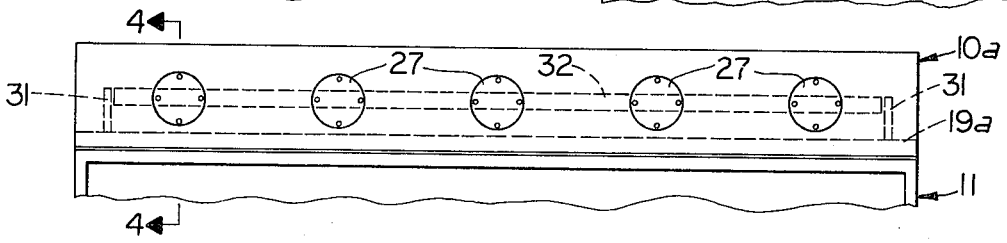
FIG. 3

ILLUMINATED BAR FOR AN ADVERTISING SIGN

BACKGROUND OF THE INVENTION

This invention relates to an illuminated bar for an advertising sign and more particularly to such a bar which is adapted to be mounted on an advertising sign to attract attention, such as by providing flashing lights or a light or lights which burn continuously.

Heretofore in the art to which my invention relates, it has been the usual practice to mount oppositely disposed flood lamps or spotlights along a supporting frame with the light bulbs actually projecting from the supporting frame. Since such bulbs are exposed to rain, many of the bulbs are broken when contacted by cold rainwater or the like. Also, since the outwardly projecting light bulb tapers inwardly toward its socket, water tends to run alongside the outer surface of the bulb to the socket, thereby making it extremely dangerous to change the light bulbs while it is raining. Not only are flood lights expensive but they consume a considerable amount of energy. This is especially true in view of the fact that, with prior art signs, a separate floodlight is required for directing light at each side from which the sign is viewed. Also, since spot and flood lamps are expensive, thievery has been a problem. In many cases, the operators of such prior art advertising signs have placed guard members around the lamps to prevent thievery. Another problem encountered with prior art advertising signs has been the fact that the electrical bulbs or lamps have been mounted in a horizontal plane whereby the light emitted therefrom passes in a generally horizontal plane toward the viewers. Over a long period of use, such horizontally mounted bulbs often become loose whereby the circuit is broken. Some illuminated bars are mounted on movable trailer signs and while being towed the horizontally mounted lamps will often break off at the tapered neck.

SUMMARY OF THE INVENTION

In accordance with my invention, I provide an illuminated bar for an advertising sign which embodies a housing which completely encases the light bulbs and is provided with upstanding side members which are spaced from each other. An electric lamp or lamps are mounted between the side members whereby light emitted at each side of the lamp is directed toward the side members. Magnifying lenses are carried by the side members at opposite sides of each lamp in position to transmit and magnify light emitted at opposite sides of the lamp whereby each individual lamp emits a bright light in opposite directions whereby the light may be viewed from opposite sides of the sign. Accordingly, my improved illuminated bar for an advertising sign requires one-half the number of light bulbs and each light bulb employed consumes only a fraction of the energy required to operate a flood light in view of the fact that my improved illuminated bar will operate satisfactorily where a conventional household light bulb of 100 wattage or less is employed. Also, the light emitted from my improved illuminated bar is non-glaring due to the fact that the light is diffused by the magnifying lenses. Furthermore, my improved illuminated light bar is extremely simple of construction, economical of manufacture and requires a minimum of maintenance to maintain the sign in operation at all times.

DESCRIPTION OF THE DRAWING

An illuminated bar for an advertising sign embodying features of my invention is illustrated in the accompanying drawing, forming a part of this application, in which:

FIG. 1 is a side elevational view showing an advertising sign having my improved illuminated bar mounted thereon;

FIG. 2 is an enlarged, sectional view taken generally along the line 2—2 of FIG. 1;

FIG. 3 is a side elevational view, partly broken away, showing a modified form of my invention; and, FIG. 4 is an enlarged, sectional view taken generally along the line 4—4 of FIG. 3.

DETAILED DESCRIPTION

Referring now to the drawing for a better understanding of my invention, I show my improved illuminated bar generally at 10 mounted along the upper edge of a conventional advertising sign indicated generally at 11. The illuminated bar 10 comprises an elongated housing having a horizontal top wall 12 connected to upstanding side members 13. As shown in FIG. 2, the upstanding side members 13 extend parallel to each other and are spaced from each other to provide a closed chamber 14. The lower ends of the upstanding side members 13 are turned outwardly as at 16 and are secured to the upper portion of the advertising sign 11 by suitable means, such as by welding at 17.

Extending transversely of the lower portion of the chamber 14 and secured to the upstanding side members 13 by suitable means, such as by welding at 18, is an elongated lamp supporting member 19. Mounted at longitudinally spaced intervals along the lamp support member 19 are a plurality of upstanding internal threads for receiving a screw-type base 22 of a conventional type electric lamp bulb 23. Electrical power is supplied to the sockets 21 by suitable electrical conduits 24.

As shown in FIG. 2, each upstanding side member 13 is provided with an opening 26 opposite each electric lamp 23. Secured to each of the upstanding side members 13 and covering each opening 26 at opposite sides of each lamp 23 is a magnifying lens 27 which is in position to transmit and magnify light emitted at opposite sides of each lamp 23. The magnifying lenses 27 may be secured to the upstanding members 13 by any suitable means, such as by screws 28. As shown in FIG. 2, the outer surface of each magnifying lens 27 is convex. Also, the lenses 27 may be of a clear type or may be of various colors to further attract the attention of viewers.

In FIGS. 3 and 4 of the drawing, I show a modified form of my invention in which an illuminated bar **10*a* comprises an elongated housing having a top wall 12*a* and an upstanding side member 13*a* at one side thereof. An upstanding side member 13*b* is hingedly connected at its upper end to the side of the top wall 12*a* opposite the side thereof connected to the upstanding member 13*a* by a hinge 29, as shown. whereby the side member 13*b* is adapted to swing outwardly to provide access to a chamber 14*a*. That is, the side members 13*a* and 13*b* extend parallel to each other and are mounted in spaced relation to each other with the lower ends thereof being secured to the advertising sign 11 by welding at 17 to provide the closed chamber 14*a***.

Secured to the lower portion of the chamber **14*a* is an elongated horizontal lamp support 19*a*. Mounted on the support 19***a* adjacent each end of the chamber 14*a* is a support bracket 31 for an elongated fluorescent lamp 32 which extends substantially the entire length of the chamber 14*a*. Electrical power is supplied to the fluorescent lamp 32 by suitable electrical conduits indicated generally at 33.

As shown in FIGS. 3 and 4, openings 26*a* are provided at longitudinally spaced intervals along the upstanding side members 13*a* and 13*b*. Extending over each of the openings 26*a* is a magnifying lens 27, as described hereinabove relative to the embodiment shown in FIGS. 1 and 2. That is, the magnifying lenses 27 are in position to transmit and magnify light emitted through the openings 26*a* at opposite sides of the fluorescent lamp 32.

From the foregoing description, the construction and operation of my improved illuminated bar for an advertising sign will be readily understood. The electric lamps 23 are installed by placing the screw-type base 22 in the threaded socket 21 and then rotating the same. Accordingly, the lamp 23 is rotated about a vertical axis whereby gravity aids in retaining the bulb 23 in place, after installation. That is, the bulb 23 is mounted above the socket 21 whereby it does not become unthreaded due to vibration. Since the housing of the illuminated bars 10 and 10*a* completely encase the lamps 23 and 32, respectively, the lamps are protected from the elements, such as rain, snow and the like, thereby greatly increasing the life of the lamps. When it is desired to replace a lamp 23, a lens 27 opposite the lamp 23 to be replaced is removed to thereby provide access to the lamp. When it is desired to replace the fluroescent lamp 32, the upstanding side 13*b* is pivoted outwardly about its hinge 29 whereby the fluorescent lamp may be readily removed and another installed. It will be apparent that one of the upstanding side members 13 of the embodiment shown in FIGS. 1 and 2 may be hingedly connected to the top wall 12 in the same manner as the upstanding side member 13*b* is hingedly connected to the top wall 12*a* by hinge 29.

From the foregoing, it will be seen that I have devised an improved illuminated bar for an advertising sign which is extremely simple of construction, economical of manufacture and one which may be operated at a minimum of cost with a minimum amount of energy. By providing magnifying lenses at opposite sides of the lamp in position to transmit and magnify light emitted at opposite sides of the lamp, each lamp is adapted to emit light which is visible from both sides of the advertising sign, thus reducing the number of lamps required to light both sides of a sign. Also, by completely encasing the lamps within the bar housing, the lamps are not only protected from the elements but are also protected from thieves. Furthermore, since my improved illuminated bar does not require expensive flood lamps, the lamps not only cost less but the amount of thievery is greatly reduced.

While I have shown my invention in two forms, it will be obvious to those skilled in the art that it is not so limited, but is susceptible of various other changes and modifications without departing from the spirit thereof.

What I claim is:

1. An illuminated bar for use with an advertising sign, said bar comprising, (a) an elongated housing having spaced apart upstanding side members, (b) means mounting at least one electric lamp between said upstanding side members, and (c) longitudinally spaced magnifying lenses carried by each said upstanding side member at opposite sides of said lamp with each of said lenses being opposite one of a plurality of longitudinally spaced openings in said side members in position to transmit and magnify light emitted at said opposite sides of said lamp.

2. An illuminated bar for use with an advertising sign as defined in claim 1 in which a plurality of longitudinally spaced electric lamps are mounted between said upstanding side members with said magnifying lenses being at opposite sides of each lamp.

3. An illuminated bar for use with an advertising sign as defined in claim 1 in which said electric lamp is an elongated fluorescent lamp.

4. An illuminated bar for use with an advertising sign as defined in claim 1 in which said housing completely encases said electric bulb.

* * * * *